US010731894B2

(12) United States Patent
Bauer et al.

(10) Patent No.: US 10,731,894 B2
(45) Date of Patent: Aug. 4, 2020

(54) HEATING BLOCK HALF-SHELL, AND HEATING BLOCK WITH GUIDE ELEMENTS FOR A HEATING COIL

(71) Applicant: BSH HAUSGERÄTE GMBH, München (DE)

(72) Inventors: Franz Bauer, Traunwalchen (DE); Christian Englisch, Ruhpolding (DE); Gebhard Mayer, Traunstein (DE)

(73) Assignee: Robert Bosch GmbH, Stuttgart (DE)

( * ) Notice: Subject to any disclaimer, the term of this patent is extended or adjusted under 35 U.S.C. 154(b) by 248 days.

(21) Appl. No.: 15/751,672

(22) PCT Filed: Aug. 24, 2016

(86) PCT No.: PCT/EP2016/069933
§ 371 (c)(1),
(2) Date: Feb. 9, 2018

(87) PCT Pub. No.: WO2017/036872
PCT Pub. Date: Mar. 9, 2017

(65) Prior Publication Data

US 2018/0238584 A1 Aug. 23, 2018

(30) Foreign Application Priority Data

Sep. 3, 2015 (DE) ..... 10 2015 216 937

(51) Int. Cl.
*F24H 1/10* (2006.01)
*F24H 9/18* (2006.01)
*F24H 1/12* (2006.01)

(52) U.S. Cl.
CPC ..... *F24H 1/103* (2013.01); *F24H 1/121* (2013.01); *F24H 9/1818* (2013.01)

(58) Field of Classification Search
None
See application file for complete search history.

(56) References Cited

U.S. PATENT DOCUMENTS

2008/0173636 A1 7/2008 Kutz
2015/0168010 A1* 6/2015 Jansen ..... F24H 1/103 392/484

FOREIGN PATENT DOCUMENTS

DE 1091249 B 10/1960
DE 1893992 U 6/1964
DE 1968231 U 9/1967
DE 8525128 U1 10/1985
(Continued)

OTHER PUBLICATIONS

DE 1968231 U, Eckerfield, Sep. 1967, partial translation.*
(Continued)

*Primary Examiner* — Joseph M Pelham
(74) *Attorney, Agent, or Firm* — Norton Rose Fulbright US LLP; Gerard Messina

(57) ABSTRACT

A heating block half-shell and a heating block for a continuous flow heater, each half-shell including a (partial) wall for a heating channel that includes at least one straight section. In the at least one straight section, at least two guide elements are situated in succession on the wall in the axial direction, each being configured for supporting a heating coil in the heating channel in the radial direction. A continuous flow heater that includes a heating block of this type is also described.

9 Claims, 3 Drawing Sheets

(56) References Cited

FOREIGN PATENT DOCUMENTS

| | | | | | |
|---|---|---|---|---|---|
| DE | 19651079 | A1 | | 6/1998 | |
| DE | 19651087 | A1 | | 6/1998 | |
| DE | 102011082106 | A1 | | 3/2013 | |
| DE | 102012013348 | A1 | | 1/2014 | |
| DE | 102013212205 | A1 | | 12/2014 | |
| GB | 2320086 | A | * | 6/1998 | ..... F24H 1/102 |
| JP | S414373 | Y | | 3/1966 | |
| JP | S63104949 | U | | 7/1988 | |

OTHER PUBLICATIONS

DE 1091249, Hielscher et al, Oct. 1960, partial translation.*
International Search Report dated Nov. 2, 2016, of the corresponding International Application PCT/EP2016/069933 filed Aug. 24, 2016.
Office Action issued in corresponding patent application JP 2018-511642 dated Apr. 10, 2020.

* cited by examiner

HEATING BLOCK HALF-SHELL, AND HEATING BLOCK WITH GUIDE ELEMENTS FOR A HEATING COIL

FIELD

The present invention relates to a heating block half-shell for a continuous flow heater, in particular for a household continuous flow heater. Moreover, the present invention relates to a heating block, and a continuous flow heater that includes a heating block.

BACKGROUND INFORMATION

Conventional electric household continuous flow heaters include one or multiple heating blocks, each including at least one heating channel that has generally a meander-shaped design, through which in each case liquid (in particular water) may be passed through, and in which a heating coil is situated.

This type of heating block may include, in at least one section, two assembled heating block half-shells. Each of the heating block half-shells may form a partial wall for the heating channel. When the two heating block half-shells are assembled, the two partial walls together form a tube that encloses at least a portion of the heating channel.

The heating coil is formed from a heating wire that is generally helically wound around a coil center. The heating coil represents an electrical resistor that heats up when electrical current passes through, and releases heat to the water flowing around it.

To avoid local overheating (resulting in the formation of so-called "hot spots") and also to prevent adhesion of air bubbles and the mechanical oscillation of the heating coil (with accompanying noise emissions), the heating coil must be mounted in the heating channel in a suitable position.

For this purpose, in conventional heating blocks, a heating channel is formed in such a way that narrow guide ribs center the heating coil in the heating channel. Between straight sections, the heating channel includes turning sections in which the channel routing is deflected by 180°. The guide ribs each extend across the straight sections of the heating channel, and grip the helically wound heating coil on its outer side.

The guide ribs create spaces between the heating coil and an inner wall of the heating block (which forms a wall of the heating channel) and position the heating coil in the center of the heating channel. Water that is conducted through the heating channel thus flows to a small extent through the (outer) spaces, and to a different, greater extent through an open space in the middle of the heating coil.

An increased flow resistance occurs in the spaces, and in particular the guide ribs generate disadvantageous turbulences, and the flow velocity in the spaces is reduced. Uniform flow of water, to be heated, around the heating coil is thus prevented.

In an alternative approach that is described in German Patent Application No. DE 10 2012 013 348 A1, the heating channel includes an undulated section with a heating coil fixed to its ends. Due to the undulation of the section, the heating coil rests against the heating channel wall at various locations, and is thereby positioned.

However, in such heating channels an increased flow resistance is generated due to the undulation. In addition, the heating blocks with undulated sections are costly to manufacture.

SUMMARY

An object of the present invention is to avoid the stated disadvantages in a cost-effective manner.

The object may be achieved by a heating channel half-shell, a heating block, and a continuous flow heater in accordance with the present invention. Preferred specific embodiments are described herein.

A heating block half-shell according to the present invention forms a partial wall for a heating channel that includes at least one straight section. At least two guide elements are situated on the partial wall in the at least one straight section, in particular in such a way that they are situated in succession in the axial direction (i.e., a liquid to be heated that flows through in a flow direction flows around the guide elements one after the other). The guide elements are each configured for supporting the heating coil in the radial direction.

A heating block according to the present invention for a continuous flow heater forms a wall for a heating channel that includes at least one straight section and a heating coil centrally situated therein. In the at least one straight section, at least two guide elements are situated on the wall in succession in the axial direction, each configured for supporting the heating coil in the radial direction.

The guide elements, the same as the guide ribs of the known heating blocks, are thus used as supports that are configured for positioning the heating coil in a radial center of the heating channel.

Unlike the heating blocks of the related art, a heating channel that is formed by a heating block half-shell according to the present invention and a heating channel that is formed in a heating block according to the present invention include at least two guide elements that are situated in succession in the flow direction of a liquid to be heated.

Thus, in comparison to the conventional guide ribs, an axial extension of the supports for the multiple guide elements, which impairs the flow, is reduced. Flow may pass around the guide elements according to the present invention in each case within the straight section of the heating channel, so that the liquid flow is impaired only in the surroundings of the guide elements, and thus only in a short subsection of the straight section.

In addition, the reduction according to the present invention of the axial extension, compared to the conventional guide ribs, allows material savings and thus cost savings.

Lastly, the positioning of the heating coil, unlike the heating block described in German Patent Application No. DE 10 2012 013 348 A1, takes place in a straight section of the heating channel. An undulation between the turning sections of the heating channel which impairs the uniform flow may thus be avoided. Such an avoidance of the undulation also means simplified manufacture of the heating block half-shell and the heating block.

A heating block according to the present invention may include two assembled heating block half-shells, of which one or both may be designed as a heating block half-shell according to the present invention, as described in the present document.

Between the at least two guide elements, a heating block half-shell according to the present invention preferably includes at least one section in which the partial wall has a semicylindrical design, so that a cross section of the partial wall (perpendicular to a central longitudinal axis of the straight section) forms a semicircle. Similarly, a heating block according to the present invention preferably includes a section between the at least two guide elements in which one-half of the wall of the heating channel has a semicylindrical design, or in which the entire wall has a cylindrical design. In such areas, no guide elements are in the way of the liquid flowing through, so that a flow resistance for liquid to be heated is minimal.

A heating block half-shell according to the present invention and a heating block according to the present invention may each be used in a continuous flow heater, preferably a household continuous flow heater.

The straight section of the heating channel is preferably essentially cylindrical, i.e., rotationally symmetrical about a central longitudinal axis (in particular disregarding the guide elements).

According to one preferred specific embodiment of a heating block half-shell according to the present invention and a heating block according to the present invention, at least three guide elements are situated on the partial wall in the straight section, of which at least two are configured for supporting the heating coil from various sides in the radial direction.

Such a specific embodiment allows fixing of the heating coil in the center of the heating channel from various sides, in which the guide elements have only a small contact surface with the heating coil. An extension of the guide elements in a cross section (orthogonal with respect to the longitudinal axis) of the straight section may therefore be kept small, so that the guide elements represent only a small flow obstruction.

In particular, the at least three guide elements may include a guide element pair that includes two guide elements that are situated rotated with respect to one another essentially about a central longitudinal axis of the straight section. The term "guide element pair" below is understood to mean a pair of guide elements that are situated with respect to one another in this way. Mathematically, the positions of the two guide elements of a guide element pair may thus be mapped onto one another by a rotation about the central longitudinal axis.

Contact points of the two guide elements of a guide element pair on a heating coil may thus be situated in a shared cross section of the straight section (orthogonal with respect to its longitudinal axis). In particular, this specific embodiment of a heating block half-shell according to the present invention allows a heating coil in a heating block formed by combining the heating block half-shell with another heating block half-shell to be enclosed by multiple guide elements in the area of the shared cross section, and thus fixed particularly well.

One specific embodiment is particularly preferred in which a corresponding rotation angle between the two guide elements of a guide element pair is approximately 90° or approximately 120°. When such a heating block half-shell is combined with another heating block half-shell to form a heating block, in this specific embodiment, and with a suitably configured second heating block half-shell, guide elements may be uniformly situated around a heating coil. This allows a particularly good fixing of the heating coil in the heating channel.

One specific embodiment of a heating block half-shell and a heating block is preferred which, in the straight section, includes multiple guide element pairs as specified above, which are offset relative to one another in the axial direction.

According to one preferred specific embodiment, a heating block according to the present invention includes a first and a second heating block half-shell that are joined together (and optionally welded together) and at least one straight section of the heating channel, the first heating block half-shell including at least two guide element pairs of the stated type that are axially offset relative to one another, and the second heating block half-shell including at least one guide element pair that is situated between the guide element pairs of the first heating block half-shell in the axial direction; such a symmetrical shape allows a uniform fixing of the heating coil in the heating channel.

One specific embodiment of a heating block according to the present invention is advantageous in that it includes at least four guide elements on the wall, of which at least three are situated essentially at the same position in the axial direction; these three guide elements are thus not axially offset relative to one another, and are situated at various positions along the periphery of the heating channel. The three guide elements may thus radially support the heating coil from three different sides. The positions of the at least three guide elements may preferably be mapped onto one another by rotations of approximately 90° or of approximately 120° about a central longitudinal axis of the straight section.

According to one preferred specific embodiment of the present invention, at least one of the guide elements in a longitudinal section of the straight section of the heating channel includes an inwardly directed area and/or an outwardly directed area in which the guide element becomes increasingly closer to the center of the straight section, viewed in the flow direction, or becomes increasingly farther from the center, viewed in the flow direction. Along the flow direction, a distance from the center thus gradually becomes smaller in the inwardly directed area, and in the outwardly directed area gradually becomes larger. Alternatively or additionally, at least one guide element, viewed in the flow direction, may include partial areas that become increasingly closer to the center at one or both sides (i.e., in the cross section of the straight section along the periphery of the wall).

Abrupt changes in direction of a liquid that is flowing through may be avoided in this way. In particular, turbulences may be reduced when a liquid to be heated that is flowing through meets the guide element, and the liquid may be conducted in a continuous, uniform flow across the at least one guide element.

One specific embodiment is advantageous in which at least one of the guide elements in the straight section has an essentially streamlined design. Flow resistances and turbulences in the heating channel may thus be minimized. One specific embodiment is particularly preferred in which even all guide elements in the straight section have such a streamlined design.

At least one guide element may have a surface in the heating channel, for example, having the shape of an ellipsoid, in particular a rotational ellipsoid, or a lens (i.e., which forms a portion of a surface of the (rotational) ellipsoid or of a lens). Such shapes are particularly favorable in terms of flow.

According to one preferred specific embodiment, a heating block half-shell according to the present invention is made at least partially of plastic. The plastic is used as electrical insulation; in addition, these types of heating block half-shells are inexpensive and easy to manufacture, and may be combined with at least one further heating block half-shell, made at least partially of plastic, and welded. Accordingly, a heating block according to the present invention preferably includes a housing that is at least partially formed from plastic.

One preferred embodiment variant of the present invention relates to a continuous flow heater, in particular a household continuous flow heater, that includes a heating block half-shell or a heating block according to one of the described specific embodiments.

Preferred exemplary embodiments of the present invention are explained in greater detail below with reference to the figures. It is understood that individual elements and components may also be combined in a different way than described above or stated below.

DETAILED DESCRIPTION OF EXAMPLE EMBODIMENTS

Figure 1A:
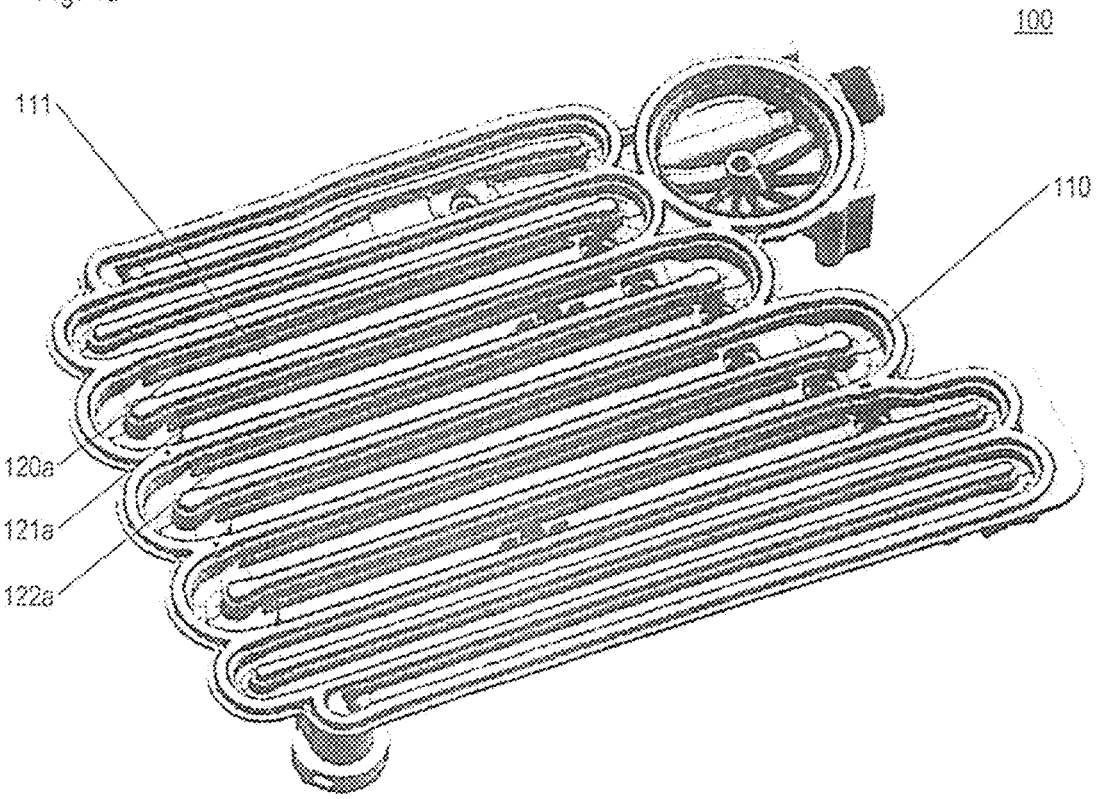
FIG. 1*a* shows a perspective view of a conventional heating block half-shell with guide ribs.

FIG. 1 illustrates a conventional heating block half-shell 100. The heating block half-shell forms a partial wall for a heating channel 110.

The heating channel includes a straight section 111 and a plurality of straight sections, not depicted in the figure, that are each configured for accommodating a heating coil (not shown) in their center. Guide ribs 120*a*, 121*a*, 122*a* and further guide ribs, not depicted, are situated in the straight sections. Guide rib 120*a* extends approximately across the full length of straight section 111, and the same applies for the further guide ribs in their respective straight sections.

Figure 1B:
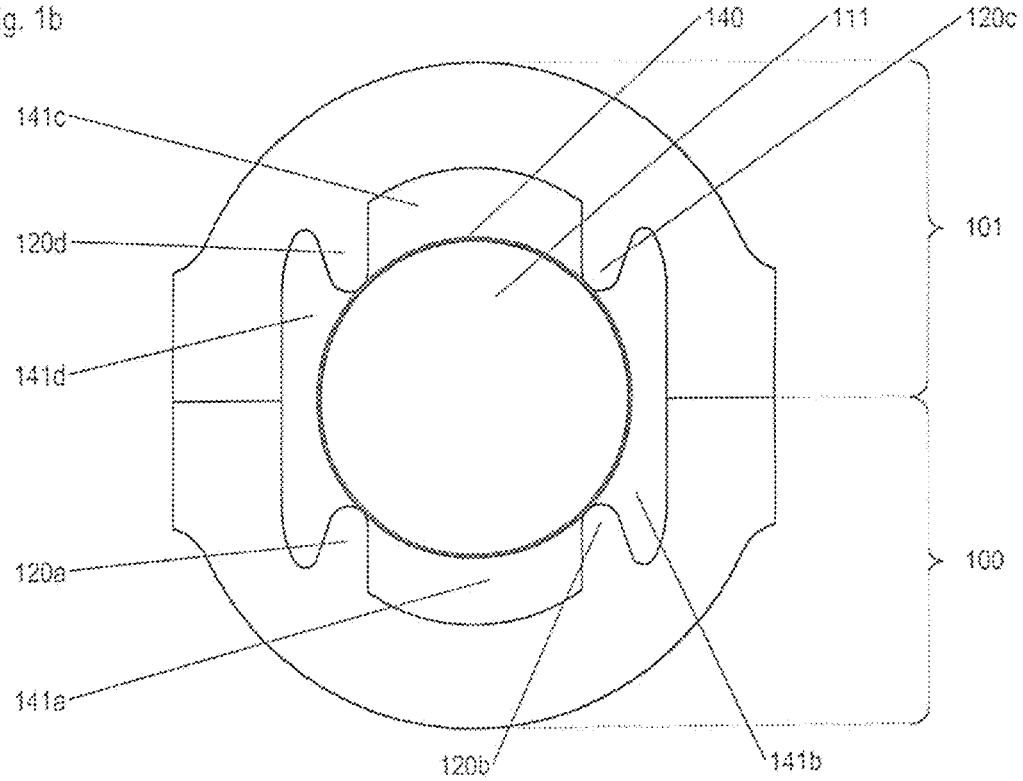
FIG. 1*b* shows a cross section of a straight section of a conventional heating block.

Due to the perspective of the illustration, for each straight section only one guide rib is discernible; however, a further guide rib in the heating block half-shell is situated opposite from the guide rib, as shown in the cross section of straight section 111 of heating channel 110 illustrated in FIG. 1*b*.

In the illustration in FIG. 1*b*, heating block half-shell 100 is combined with a further heating block half-shell 101, which likewise forms a partial wall of heating channel 110 (at the top of the figure). As shown in the figure, heating block half-shell 100 (at the bottom of the figure) includes a guide rib 120*b* in addition to guide rib 120*a*; heating block half-shell 101 (at the top of the figure) includes guide ribs 120*c* and 120*d*. The guide ribs support a heating coil 140 in the radial direction.

Spaces 141*a*, 141*b*, 141*c*, 141*d* are formed between heating coil 140 and the wall of the heating channel. Due to the formation of the guide ribs, significant flow resistances occur in these spaces for liquid to be heated that is flowing through, which hinders a uniform flow around the heating coil, and thus, uniform heating.

Figure 2:
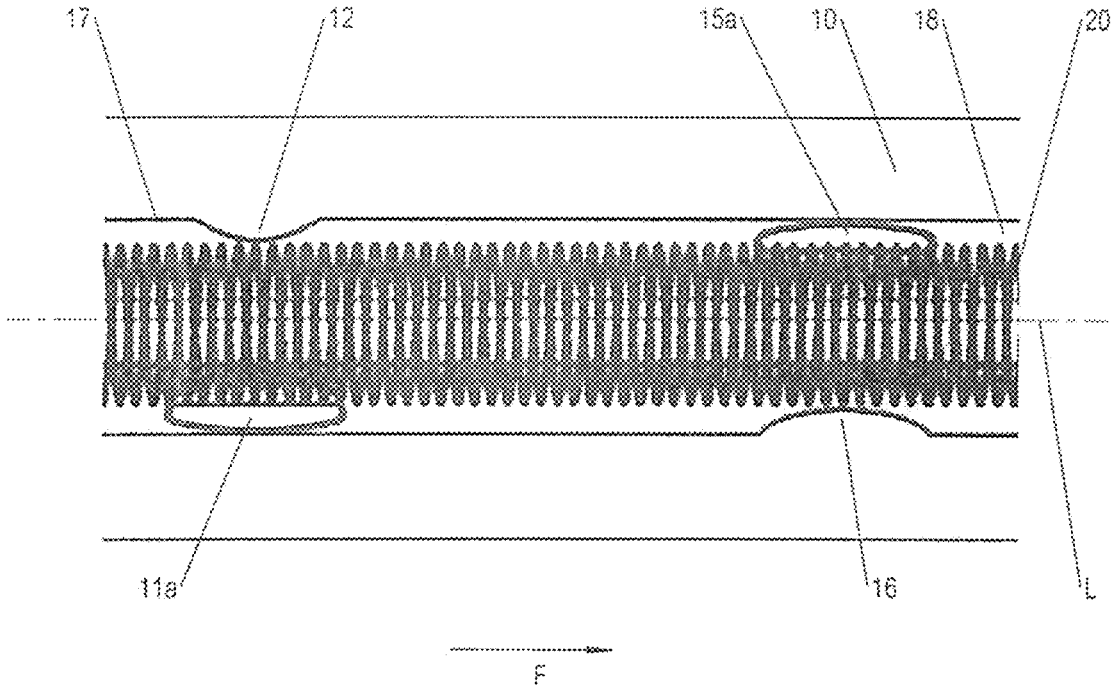
FIG. 2 shows a straight section of a heating channel in a heating block according to the present invention, in the longitudinal section.

FIG. 2 shows a straight section of a heating channel 18 in a heating block 10 according to the present invention. Heating block 10 forms a wall 17 for a heating channel 18, in the radial center of which a heating coil 20 is situated (around a central longitudinal axis L); for better recognizability, this heating coil is illustrated in a side view, not in the cross section. Guide elements 11*a*, 12, 15*a*, and 16 are situated on wall 17 of heating block 10, and support heating coil 20 in the radial direction. In particular, guide elements 12 and 15*a* are situated in succession in the axial direction (i.e., in a direction of central longitudinal axis L), and the same applies for guide elements 11*a* and 16. Guide element 15*a* is situated behind guide element 12, and guide element 16 is situated behind guide element 11*a*, viewed, for example, in flow direction F of liquid to be heated.

In the illustrated cross section, guide elements 12 and 16 are situated in a plane with longitudinal axis L; in contrast, the positions of guide elements 11*a* and 15*a* are situated rotated about the longitudinal axis, as indicated by the different illustration of guide elements 11*a* and 15*a* compared to guide elements 12 and 16, and explained in greater detail with reference to FIG. 4.

Figure 3:
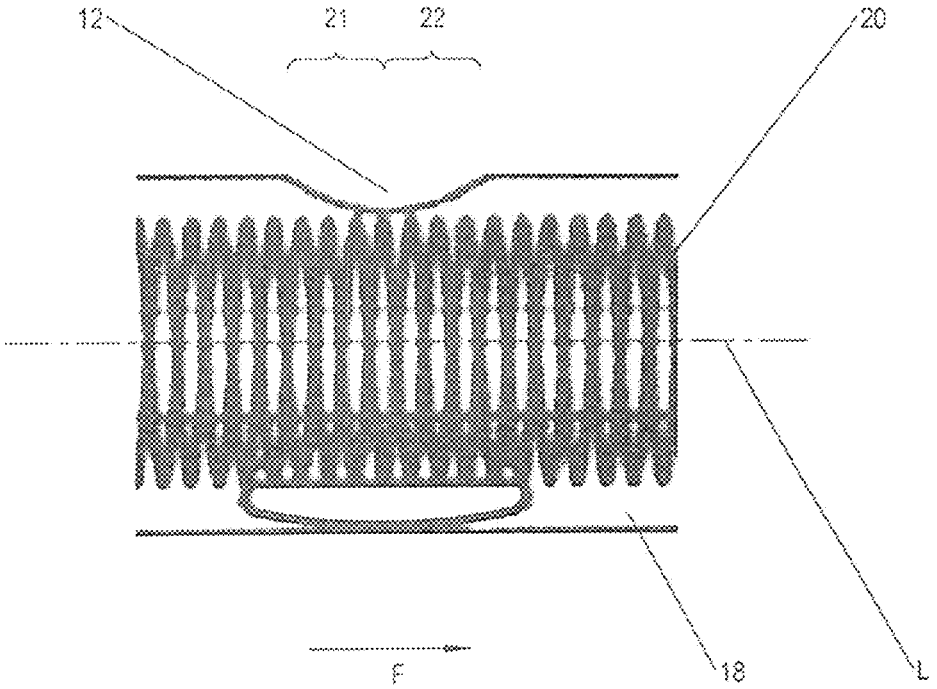
FIG. 3 shows a detail from FIG. 2.

FIG. 3 shows a detail from FIG. 2 for describing the configuration of guide element 12 in greater detail: as is apparent in the figure, this guide element includes an area 21 and an area 22.

Area 21 is an inwardly directed area in which a distance from longitudinal axis L (and thus, from the center of the illustrated straight section of heating channel 18) gradually becomes smaller along flow direction F. In contrast, area 22 is an outwardly directed area in which a distance from longitudinal axis L (and thus, from the center of the illustrated straight section of heating channel 18) gradually becomes larger along flow direction F. In other words, a surface of guide element 12 in inwardly directed area 21 leads increasingly into the interior of the heating channel along flow direction F, whereas in outwardly directed area 22 it leads away from the center along the flow direction.

Figure 4:
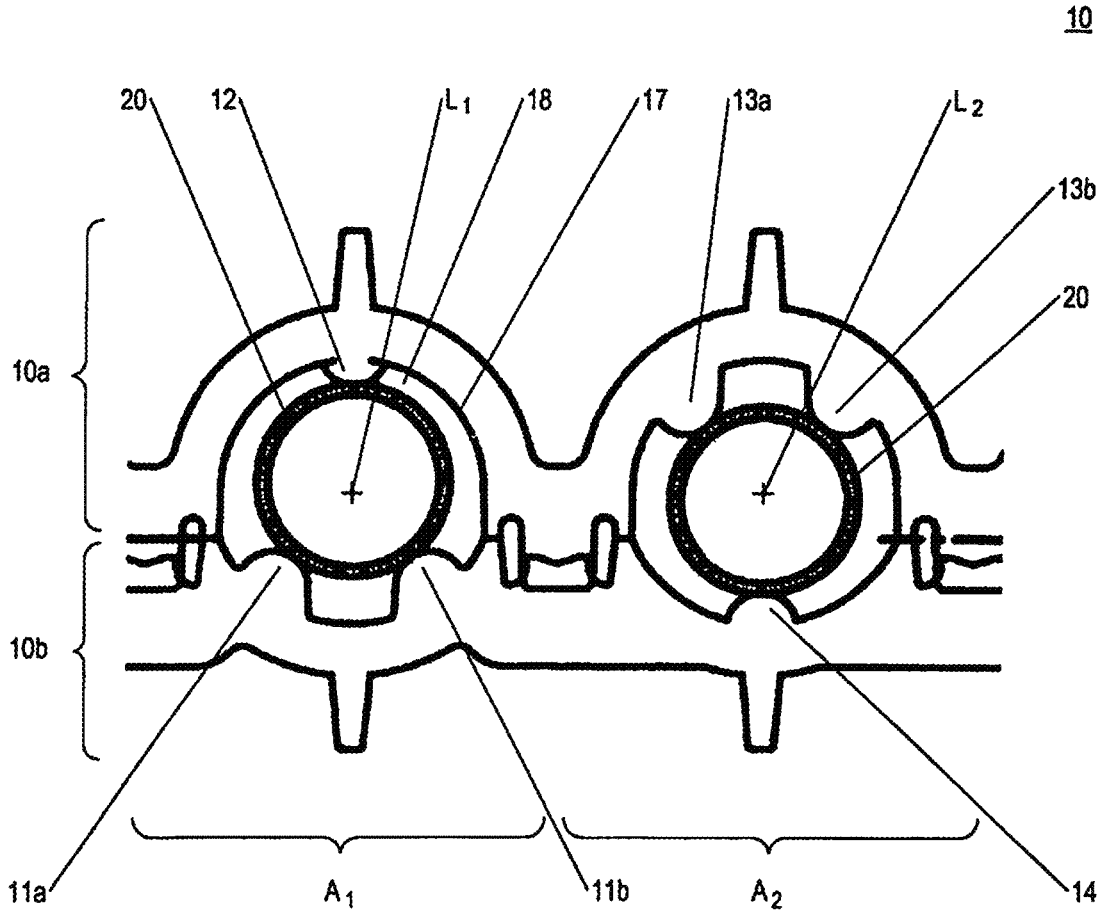
FIG. 4 shows a heating block according to the present invention in a cross section orthogonal with respect to a central longitudinal axis of a straight section of a heating channel.

FIG. 4 illustrates a portion of a heating block 10 according to the present invention in cross section, with two straight sections $A_1$ and $A_2$ of a heating channel 18. In the two straight sections, the heating channel has a central longitudinal axis $L_1$ and $L_2$, respectively, and the illustrated cross section is situated in a plane orthogonal with respect to the two longitudinal axes. Section $A_1$ corresponds to the section illustrated in FIG. 2 in a longitudinal section.

The heating block shown is made up of two heating block half-shells 10*a* and 10*b*, which together form a wall 17 for heating channel 18.

In section $A_1$, the illustrated cross section includes three guide elements 11*a*, 11*b*, and 12. Guide elements 11*a* and 11*b* form a pair of guide elements in heating block half-shell 10*b* which are situated rotated with respect to one another essentially about a central longitudinal axis of the straight section, and whose positions are thus mapped onto one another by a rotation about central longitudinal axis $L_1$. The same applies for the guide element pair in section $A_2$, formed from guide elements 13*a* and 13*b*.

In section $A_1$, single guide element 12 is situated opposite from the guide element pair made up of guide elements 11*a* and 11*b*.

The arrangement, apparent in FIG. 4, of the guide elements as a guide element pair 11*a*, 11*b* and individual guide element 12 clarifies the illustration in FIG. 2: in particular, as is apparent in FIG. 4, guide element 11*a* is not situated in a plane that encompasses longitudinal axis L and guide element 12; this plane is the section plane in FIG. 2.

On this basis, as well as from the illustration of guide elements 15*a* and 16 in FIG. 2, it also becomes apparent that these guide elements are situated analogously to guide elements 11*a* and 12, except that here, guide element 15*a*, at the top in the illustration, is part of a guide element pair. A cross section of guide elements 15*a* and 16 would thus be analogous to the cross section shown for section $A_2$ in FIG. 4. Heating block 10 thus includes in particular two guide element pairs that are offset relative to one another in the axial direction. In this way, the heating coil may be advantageously fixed essentially in the center of the heating channel.

The illustrations in FIGS. 2, 3, and 4 in combination also show that guide elements 11*a*, 11*b*, and 12 have rounded surfaces and a streamlined design in the longitudinal direction and also in the cross section of straight section $A_1$. Flow resistances in the heating channel are thus minimized, which allows a uniform flow and thus, uniform heating of liquid to be heated. In particular, guide element 12 has a particularly advantageous surface that conforms to a portion of a surface of an ellipsoid.

What is claimed is:

1. A heating block half-shell for a continuous flow heater, comprising:

a partial wall for a heating channel that includes at least one straight section;

at least two guide elements in the at least one straight section, the guide elements being situated in succession on the partial wall in an axial direction, each of the at least two guide elements being configured for supporting a heating coil in the heating channel in a radial directions;

wherein at least one of the guide elements has a surface that corresponds to a curved surface of an ellipsoid, in which the at least one of the guide elements includes a first area and a second area, wherein the first area is an inwardly directed area in which a distance from a longitudinal axis and from a center of a straight section of the heating channel becomes smaller along a flow direction, and wherein the second area is an outwardly directed area in which a distance from the longitudinal axis and from the center of the straight section of the heating channel becomes larger along the flow direction, so that the surface of the guide element in the first area, which is the inwardly directed area, leads into the interior of the heating channel along the flow direction, and wherein in the second area, which is the outwardly directed area, leads away from the center along the flow direction.

2. The heating block half-shell as recited in claim 1, wherein at least three guide elements are situated on the partial wall in the straight section, of which at least two are configured for supporting the heating coil from various sides in the radial direction.

3. The heating block half-shell as recited in claim 2, wherein a first guide element is situated rotated with respect to a second guide element about the central longitudinal axis of the straight section.

4. The heating block half-shell as recited in claim 1, wherein at least one of the guide elements, in at least one of a longitudinal section and a cross section of the heating channel, includes at least one of an inwardly directed area, and an outwardly directed area, in which a distance from the center gradually becomes one of smaller or larger.

5. The heating block half-shell as recited in claim 1, wherein at least one of the guide elements is adapted to the partial wall of the heating channel, so as to reduce flow resistance and/or turbulence in the heating channel, in at least one of the axial and the radial direction.

6. A heating block for a continuous flow heater, comprising:

two heating block half-shells, which are combined so as to form:

a wall for a heating channel that includes at least one straight section, the heating channel having a radial center in which a heating coil is situated; and at least two guide elements in the at least one straight section, the guide elements being situated in succession on the wall in an axial direction, each of the at least two guide elements being configured for supporting the heating coil in a radial direction;

wherein at least one of the guide elements has a surface that corresponds to a curved surface of an ellipsoid, in which the at least one of the guide elements includes a first area and a second area, wherein the first area is an inwardly directed area in which a distance from a longitudinal axis and from a center of a straight section of the heating channel becomes smaller along a flow direction, and wherein the second area is an outwardly directed area in which a distance from the longitudinal axis and from the center of the straight section of the heating channel becomes larger along the flow direction, so that the surface of the guide element in the first area, which is the inwardly directed area, leads into the interior of the heating channel along the flow direction, and wherein in the second area, which is the outwardly directed area, leads away from the center along the flow direction.

7. The heating block as recited in claim 6, wherein at least four guide elements are situated on the wall in the straight section, of which at least three of the guide elements are situated at a same position in the axial direction, and are configured for supporting the heating coil from various sides in the radial direction.

8. The heating block as recited in claim 6, wherein the heating block is assembled from two heating block half-shells.

9. An electric continuous flow heater, comprising:

a heating block, the heating block including:

two heating block half-shells, which are combined so as to form:

a wall for a heating channel that includes at least one straight section, the heating channel having a radial center in which a heating coil is situated; and at least two guide elements in the at least one straight section, the guide elements being situated in succession on the wall in an axial direction, each being configured for supporting the heating coil in a radial direction;

wherein at least one of the guide elements has a surface that corresponds to a curved surface of an ellipsoid, in which the at least one of the guide elements includes a first area and a second area, wherein the first area is an inwardly directed area in which a distance from a longitudinal axis and from a center of a straight section of the heating channel becomes smaller along a flow direction, and wherein the second area is an outwardly directed area in which a distance from the longitudinal axis and from the center of the straight section of the heating channel becomes larger along the flow direction, so that the surface of the guide element in the first area, which is the inwardly directed area, leads into the interior of the heating channel along the flow direction, and wherein in the second area, which is the outwardly directed area, leads away from the center along the flow direction.

* * * * *